US007355369B2

(12) United States Patent
Lavieville et al.

(10) Patent No.: US 7,355,369 B2
(45) Date of Patent: Apr. 8, 2008

(54) ON-LOAD TRANSFORMER TAP CHANGING SYSTEM

(75) Inventors: Jean-Paul Lavieville, Saint Lambert des Bois (FR); Witold Weber, Saint Michel sur Orge (FR); Mohamed Ryadi, Le Mans (FR); Milan Saravolac, Levallois-Perret (FR)

(73) Assignee: Areva T&D SA, Paris la Defense (FR)

( * ) Notice: Subject to any disclaimer, the term of this patent is extended or adjusted under 35 U.S.C. 154(b) by 0 days.

(21) Appl. No.: 11/183,991

(22) Filed: Jul. 19, 2005

(65) Prior Publication Data

US 2006/0039171 A1 Feb. 23, 2006

(30) Foreign Application Priority Data

Jul. 20, 2004 (FR) ..... 04 51585

(51) Int. Cl.
*G05F 1/14* (2006.01)

(52) U.S. Cl. ..... 323/255; 323/340

(58) Field of Classification Search ..... 323/209, 323/255, 257, 258, 340, 343
See application file for complete search history.

(56) References Cited

U.S. PATENT DOCUMENTS 4,562,338 A * 12/1985 Okami ..... 219/503
4,860,145 A * 8/1989 Klingbiel ..... 361/18
4,888,545 A * 12/1989 Celenza et al. ..... 323/258
5,969,511 A 10/1999 Asselman et al.
6,472,851 B2 * 10/2002 Hammond ..... 323/258
6,559,562 B1 * 5/2003 Rostron ..... 307/130

FOREIGN PATENT DOCUMENTS

EP 0 644 562 A1 3/1995
JP 8-288154 11/1996
WO WO 01/22447 A1 3/2001

OTHER PUBLICATIONS

Database WPI, AN 1997-026938, XP-002319314, JP 08-288154, Nov. 1, 1996.

* cited by examiner

*Primary Examiner*—Adolf Berhane
(74) *Attorney, Agent, or Firm*—Oblon, Spivak, McClelland, Maier & Neustadt, P.C.

(57) ABSTRACT

An on-load transformer tap changing system, for example for a power transformer, wherein the secondary or primary of a transformer includes at least one first tap and one second tap. A main connection circuit is used for permanent connection of the first tap or the second tap to an output terminal of the secondary or primary of the transformer. Secondary connection circuits are each used to connect a tap temporarily and directly to the output terminal of the secondary or primary of the transformer. Each of the connection circuits includes one or more insulated gate bipolar transistors. The system can be controlled without zero current value transition detection in the secondary winding.

1 Claim, 7 Drawing Sheets

ON-LOAD TRANSFORMER TAP CHANGING SYSTEM

BACKGROUND OF THE INVENTION

1. Field of the Invention

The invention relates to an on-load transformer tap changing system used to regulate the output voltage of the transformer secondary by changing the winding ratio. In fact, in numerous applications, the load applied to a transformer may vary and it is nevertheless necessary to maintain a substantially constant output voltage.

2. Discussion of the Background

For this, varying the winding ratio of the transformer is known. These changes are generally made using intermediate taps provided on the secondary or primary of the transformer and using tap changers which are used in this way to modify the winding ratios. These tap changers must function on-load so as not to break the electric current flow. However, the switching of these tap changers induces electrical arcs which are the cause of the degradation of the oil present to provide insulation. Regular maintenance must be carried out to maintain the insulation performances of the fluid.

FIG. 1 shows an example of a transformer tap changing system (OLTC) known in the prior art.

The transformer tap changer comprises an on-load setting switch CX and a selector SE comprising the intermediate taps 1, 2 and 3 of the secondary of the transformer TR.

The taps of the selector set the winding ratios that can be used. The switch CX is designed so as to limit stress during load tap changes.

The setting switch CX comprises a rotary switch CR used to connect an operating output B2 to one of the fixed contacts A to D of the rotary switch. The moving contact of the rotary switch has a sufficient contact surface area to make it possible to connect the output B2 to two fixed contacts next to the rotary switch simultaneously.

In FIG. 1, the rotary switch is in a position connecting the output B2 to the tap 2 of the transformer secondary. To change from the transformer tap 2 to tap 1, it is necessary to turn the rotary switch CR. Said switch first connects the output B2 at the same time to the fixed contacts A and B, and then changes to the fixed contact B thus inserting the impedance ZA into the transformer secondary circuit without breaking the circuit. Then, the moving contact connects the output B2 to the fixed contacts B and C. The load taps 1 and 2 are both connected to the output B2 via the impedances ZA and ZB respectively. Then, the moving contact connects the output B2 to the fixed contact C, i.e. to the transformer tap 1 via the impedance ZB, and then to the two fixed contacts C and D. Finally, it connects the output B2 to the fixed contact D thus only connecting the output B2 to the tap 1.

Therefore, the change of transformer load taps (from tap 1 to tap 2) is made without breaking the transformer secondary circuit. Any other tap change would result in similar sequences.

Therefore, the electrical circuit is never open during a tap change by providing a transient state where a portion of the transformer winding is short-circuited.

In addition, to prevent a prohibitive current, impedances ZA and ZB are placed in series in the circuit.

However, when the moving contact switches to the fixed contacts A to C, electrical arcs may appear on the contacts, which represent a drawback as mentioned above.

FIGS. 2*a* and 2*b* represent a type of on-load transformer tap changer known in the prior art and used to prevent the formation of electrical arcs during tap switching. This changer uses semiconductor switching circuits using gate turn-off (GTO) thyristors and mechanical switches used to reduce the tap changing time in the absence of an electrical arc.

The principle of this selector is similar to that described above but the switch is modified: the resistors and the rotary switch are replaced by semiconductor switching circuits IN1, IN2, IN3, an auxiliary transformer tra and mechanical switches S1 to S5.

The circuit comprising the auxiliary transformer tra and the switching circuit IN2 provide, as described, for example, in the document EP0644562, the permanent connection of the output terminal B2 to a tap of the secondary of the transformer TR.

The switching circuits IN1 to IN3 are produced as represented in FIG. 2*b*. Each switching circuit comprises four diodes and a gate turn-off thyristor.

In FIG. 2*a*, if it is assumed that the system is such that the contacts S2 and S4 are closed and the switching circuit IN2 is conductive, the power supply from the transformer TR is supplied via the tap 2. If the winding ratio is to be modified and the system switched so that the power supply is provided via the tap 1, the system in FIG. 2*a* will complete the following process:

- closure of the switch S1,
- detection of the zero transition of the load current and once said current passes via zero, opening of the switching circuit IN2 and closure of the switching circuit IN1. A few moments later, the switch S4 is opened when the magnetic current of the auxiliary transformer passes through it,
- detection again of the zero transition of the load current, closure of the switching circuit IN3 and opening of the switching current IN1,
- closure of the switch S5 while the current is not zero,
- detection again of the zero transition of the load current, closure of the switching circuit IN2 and opening of the switching current IN3. The circuit is now connected to the tap 1 of the transformer.

This operation is illustrated by the timing diagrams in FIG. 2*c*. In these diagrams, the operation of each contact and each switching circuit of the system in FIG. 2*a* is individualised by a specific diagram. For the contacts S1 to S5, the top sections of the diagrams represent the closed positions of the contacts, the bottom sections represent the open positions of the contacts, and for the switching circuits IN1 to IN3, the top sections represent the conductive states of said circuits and the bottom sections, the non-conductive states.

In the bottom section of FIG. 2*c*, the current flowing in the secondary winding of the transformer TR is represented. This is necessary because the switching of the switching circuits IN1 to IN3 must be carried out in the absence of current flow or possibly at a very low or negligible current.

Therefore, it can be seen that this system has the drawback of requiring the detection of the zero transition of the load current whenever the state of the switching circuits IN1 to IN3 is to be changed so that the switching of these circuits is carried out at the lowest current possible.

It should be noted that the switching time of the switches S1 to S5 is markedly greater than the switching time of the switching circuits IN1 to IN3.

In addition, the gate turn-off thyristors provided in the switching circuits IN1 to IN3 require limitation of the voltage variations on the terminals of said thyristors during the switching thereof. As represented in FIG. 2*b*, a resistor-capacitor type circuit CN is then provided to control the voltage variations at the thyristor terminals and an inductive resistor in series with the resistor reduces the current variation rate. The size of these RC circuits and of the inductive resistors is linked with the amplitude of the switched current.

In addition, the trigger current applied to the gate G and necessary to control the thyristor turn-off is proportional to the switched current.

Therefore, the system in FIGS. 2*a* and 2*b* involves the drawback of requiring circuits associated with the thyristors to limit the voltage and current of these components.

In addition, as described above, a load current zero transition detection circuit must be provided. The drawback of this solution also lies in the reliability of the equipment associated with the need for a load current zero transition detection circuit.

In addition, the use of such a control principle for a three-phase application induces a transitory imbalance during the changes. In fact, the current is not zero in the three phases simultaneously. Therefore, the switching of the current of each of the phases is not simultaneous and one detection circuit per phase must be used.

SUMMARY OF THE INVENTION

The invention relates to a system used to solve these drawbacks. Therefore, the invention relates to an on-load transformer tap changing system wherein the secondary or primary comprises at least one first tap and one second tap. This system comprises a main connection circuit used to connect the first tap or the second tap in a permanent or quasi-permanent manner (steady state condition) to an output terminal of the transformer secondary or primary. A first secondary connection circuit is used to connect the first tap temporarily and directly to said output terminal of the transformer secondary or primary. A second secondary connection circuit is used to connect the second tap temporarily and directly to said output terminal. Each of said connection circuits comprises one or more insulated gate bipolar transistors.

In addition, a central control circuit controlling the operation of said connection circuits is provided. This central control circuit does not comprise a secondary current zero transition detection device.

Moreover, it is provided that the main connection circuit comprises an auxiliary insulation transformer wherein the primary winding is used to connect a tap of said transformer to said output terminal and wherein the secondary winding may be short-circuited by the conduction of a switching circuit.

The first tap being connected to the output terminal via the first switching current, the central control circuit comprises a sequential enabling, preferentially, the operation of the following steps independently from the transformer load current value:

- conduction of the first secondary connection circuit to make a temporary parallel connection of the first tap to the output voltage,
- conduction of the second secondary connection circuit to make a temporary connection of the second tap to the output terminal,
- connection of the main connection circuit to the second tap,
- non-conduction of the first secondary connection circuit,
- conduction of the main connection circuit,
- non-conduction of the second secondary connection circuit.

BRIEF DESCRIPTION OF THE DRAWINGS

The various subjects and characteristics of the invention will emerge more clearly in the description below and in the appended figures which represent.

DESCRIPTION OF THE PREFERRED EMBODIMENTS

Therefore, with reference to FIGS. 3*a* and 3*b*, an example of an on-load transformer tap changer according to the invention is described below.

According to this embodiment example, the load taps are provided on the secondary winding of the transformer, but the system would be the same if the load taps were provided on the primary winding of the transformer.

Figure 3A:
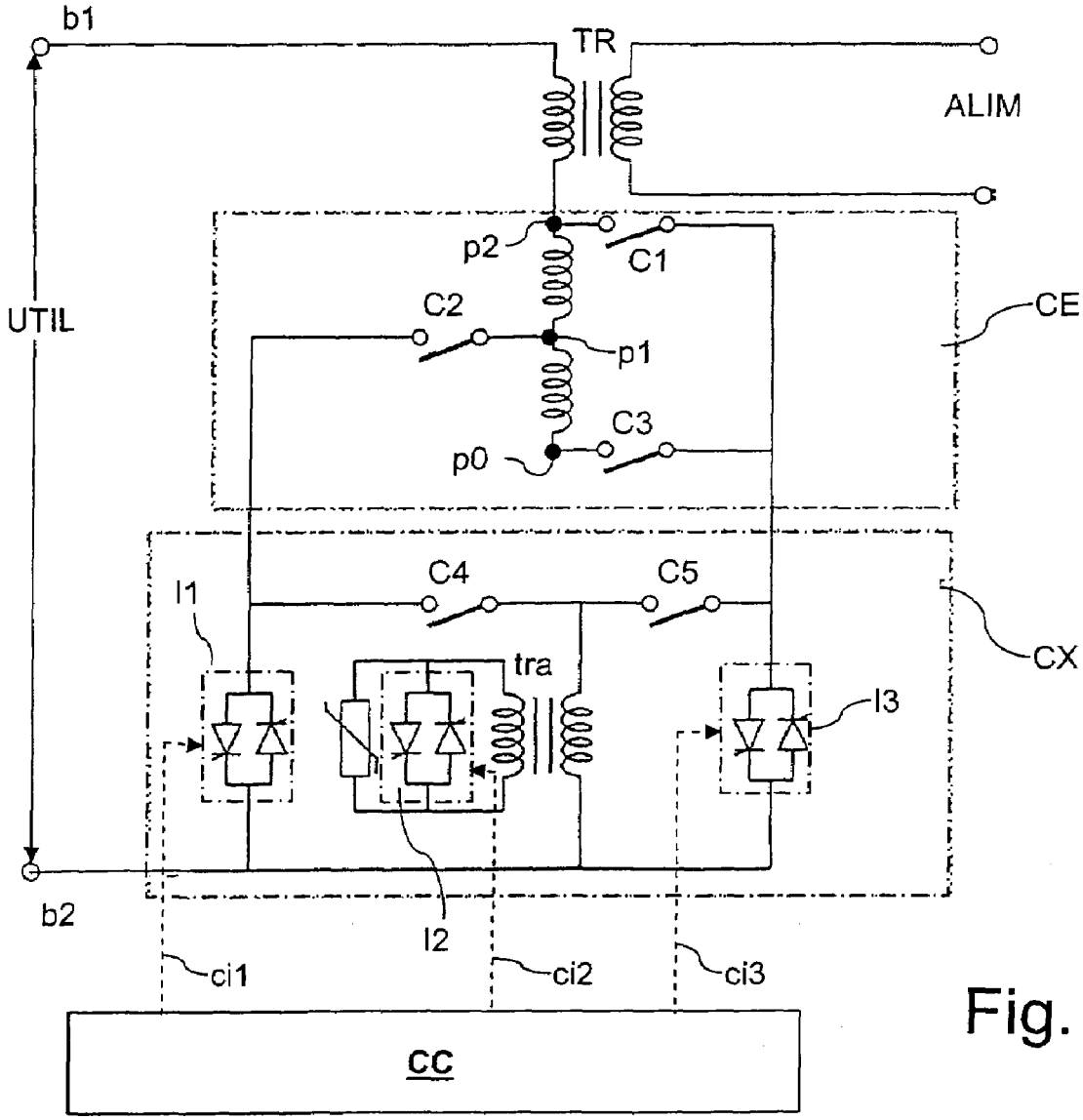
FIGS. 3*a* and 3*b*, an example of an embodiment of an on-load transformer tap changer according to the invention, FIGS. 4*a* to 4*j*, different states of the circuits in FIG. 3*a* during an on-load transformer tap change, FIG. 5, timing diagrams illustrating the different states of the system according to the invention illustrated in the FIGS. 4*a* to 4*j*.
Figure 3B:
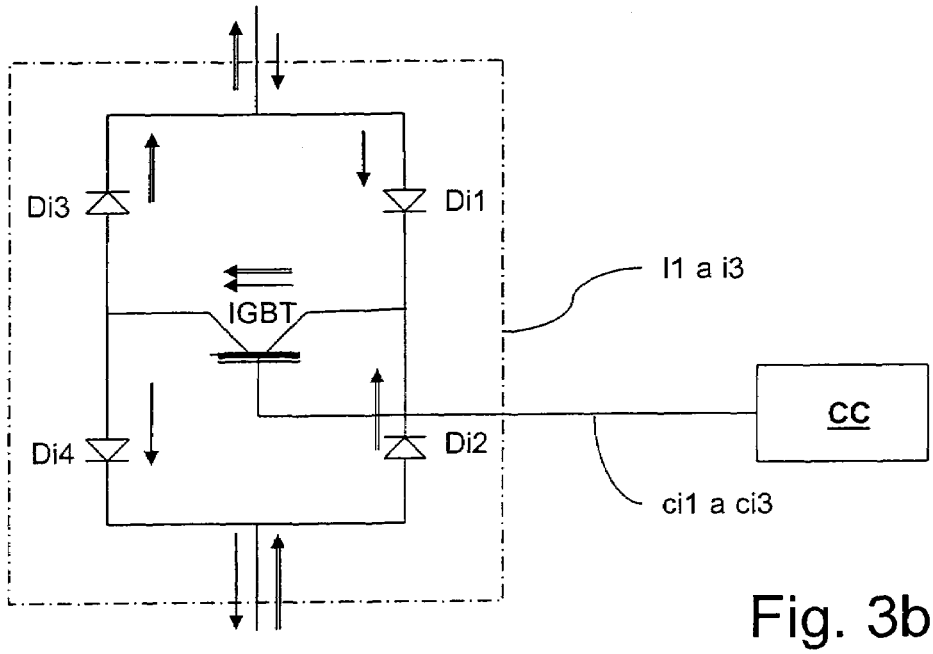

FIG. 3*a* shows the transformer TR with its primary winding connected to the mains or to an electrical power supply ALIM and with its secondary winding connected to the output terminals b1 and b2 from which an operating circuit UTIL can be connected. The secondary winding comprises the taps p0, p1, and p2, referred to as load taps, used to adapt the winding ratio of the transformer according to the load of the operating current UTIL. A switching circuit CX is used to connect the output terminal b2 to one of the load taps p0 to p2.

This switching current essentially comprises:

a main switching circuit I2 combined with an auxiliary transformer tra which is used in normal operation for the connection of the output terminal to a transformer tap p0 to p2 of the transformer secondary and therefore is used, in normal operation, for the power supply of the operating circuit by the current supplied by the transformer secondary.

two secondary switching circuits I1 and I3 used to change the load taps without breaking the transformer secondary circuit. In particular, the switching circuit I1 will be used to connect the tap p1 temporarily directly to the output terminal b2, and the switching circuit I3 will be used to connect the tap p2 temporarily to the output terminal b2.

The three switching circuits I1 to I3 are designed in the same way. FIG. 3*b* represents, as an example, a switching circuit. This circuit comprises a bridge of four diodes Di1 to Di4. An insulated gate bipolar transistor IGBT connects both arms of the bridge and enables the conduction of the current in both directions such that, for each alternation, the circuit Di1 -IGBT-Di4 is conductive and, for the following alternation, the circuit Di2-IGBT-Di3 is conductive.

This switching circuit may also comprise several insulated gate bipolar transistors IGBT with or without diodes.

The transistor IGBT is rendered conductive by applying to its gate, a +Vdc control pulse supplied by a central control circuit CC on a wire ci1 to ci3. It then remains conductive while the +Vdc control potential is applied to its gate. It is inhibited by applying another −Vdc polarity control pulse.

The transistor IGBT is designed to enable current switching.

In FIG. 3*a*, it can be seen that the three switching circuits I1 to I3 can be controlled individually by the central control circuit CC by the control wires ci1 to ci3.

The contacts C1 to C5 belong to relays not shown which are also controlled by the central control circuit.

With reference to FIGS. 4*a* to 4*j*, the operation of the circuits in FIG. 3*a* is described below.

It is assumed that the output terminal b2 is connected to the tap p1 of the transformer secondary. The system is in the situation represented in FIG. 4*a* where:

the contacts C2 and C4 are closed, the switching circuit I2 is conductive, a current flows in the parts of the circuits indicated by double arrows.

Figure 4A:
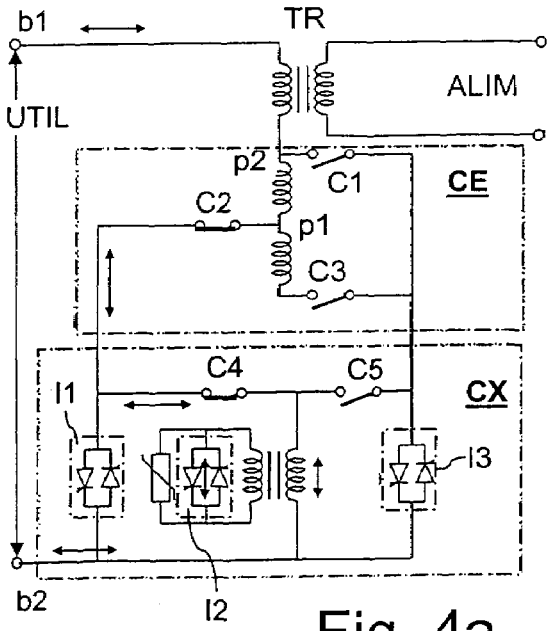
Figure 4B:
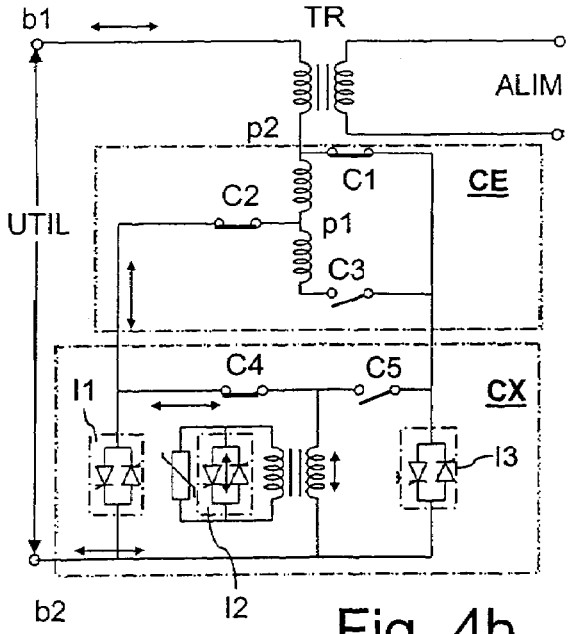
Figure 4C:
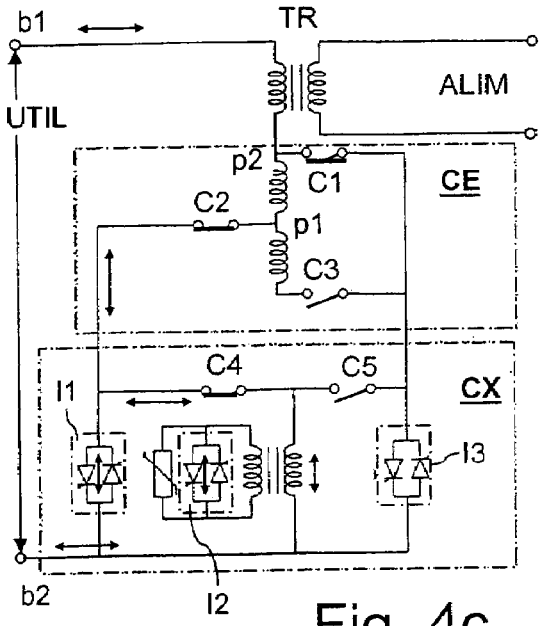
Figure 4D:
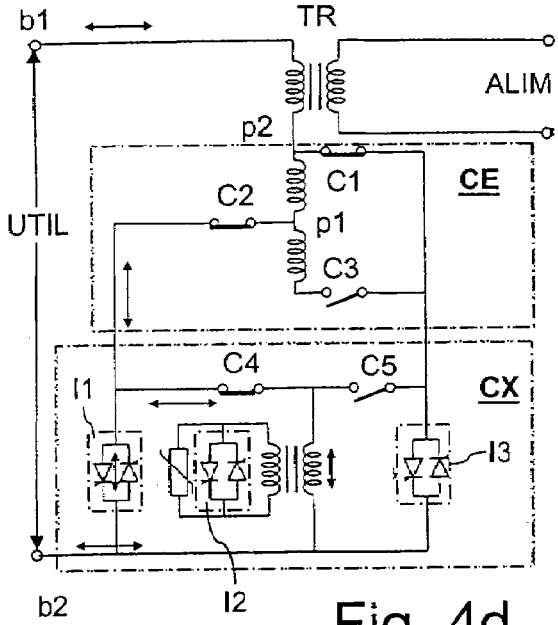
Figure 4E:
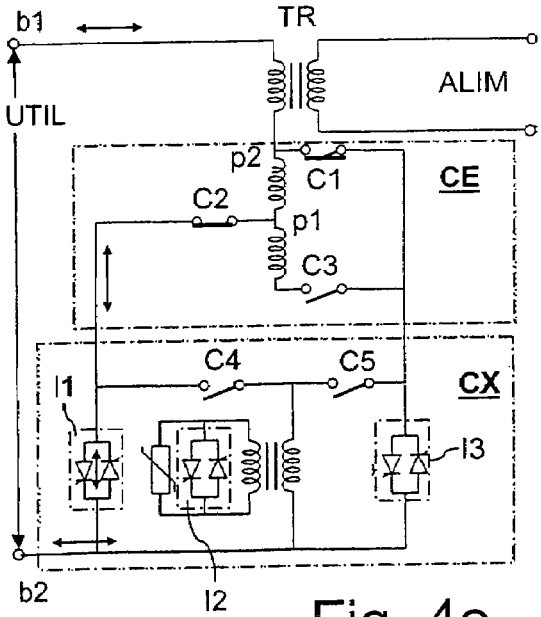
Figure 4F:
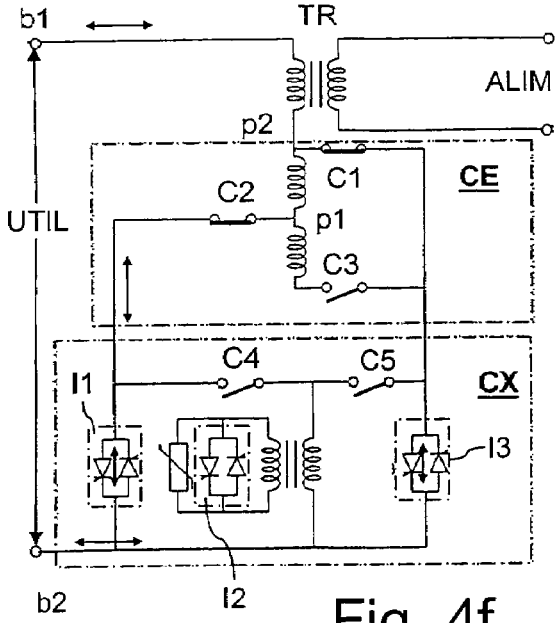
Figure 4G:
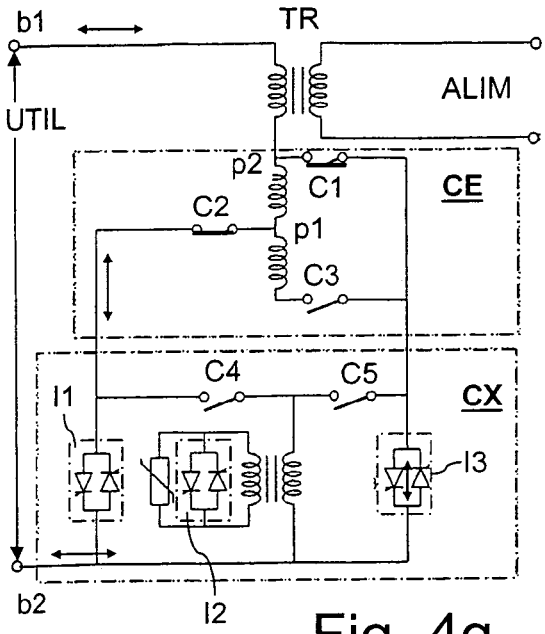
Figure 4H:
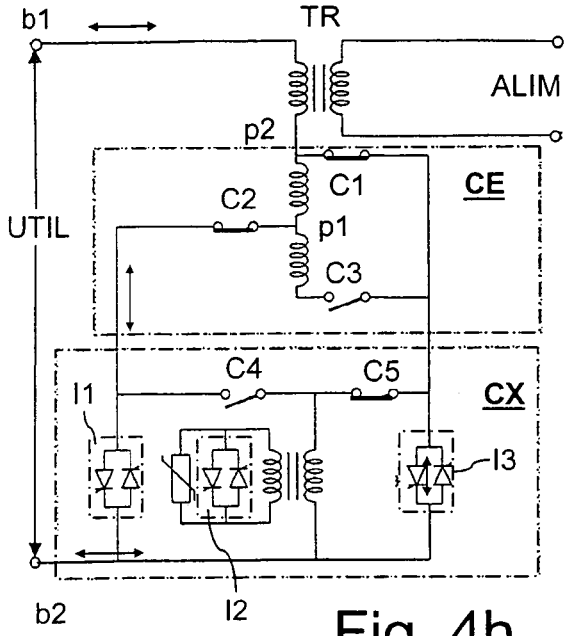
Figure 4I:
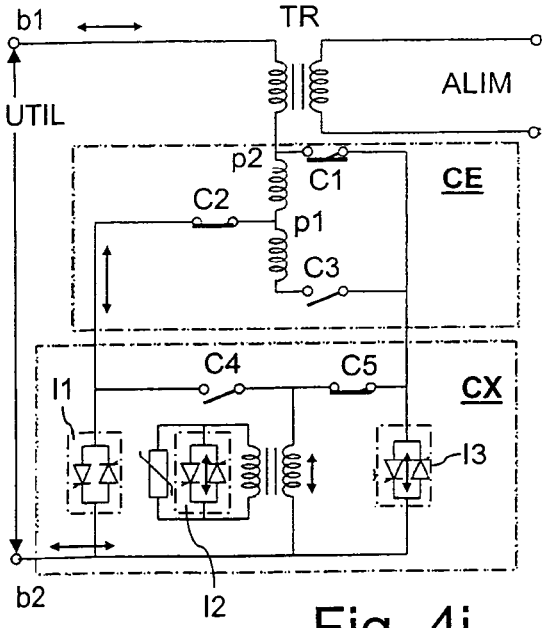
Figure 4J:
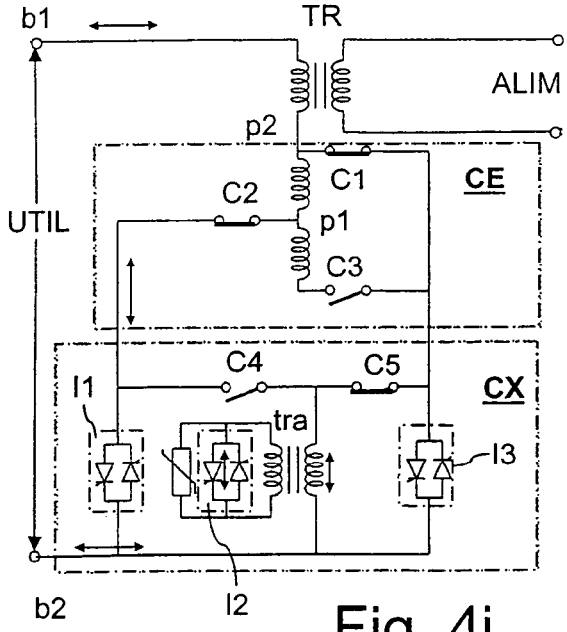

Following a change in the operating circuit load, the winding ratio of the transformer TR is to be changed. For this, for example, a connection of the output terminal b2 to the tap p2 (instead of p1) is to be made. Therefore, the central control circuit CC will control the following different steps:

step 1 (FIG. 4*b*): the contact C1 is closed to prepare the connection to the transformer tap p2. The current flows via the same circuits as above as shown in FIG. 4*b;* step 2 (FIG. 4*c*): once the contact C1 is closed, the circuit I1 is switched to render it conductive;

step 3 (FIG. 4*d*): almost simultaneously with step 2 or after step 2, the circuit I2 is switched to render it non-conductive;

step 4 (FIG. 4*e*): then, the contact C4 is opened which prepares the break of the connection to the transformer tap p1;

step 5 (FIG. 4*f*): after the contact C4 is opened, the circuit I3 is switched so as to render it conductive and prepare the connection to the transformer tap p2;

step 6 (FIG. 4*g*): the circuit I1 is then switched to render it non-conductive which breaks the connection to the transformer tap p1;

step 7 (FIG. 4*h*): more or less at the same time as step 6 or after this step, the contact C5 is closed to prepare the permanent connection to the transformer tap p2;

step 8 (FIG. 4*i*): then, the circuit I2 is switched to make the connection to the tap p2 via the auxiliary transformer tra;

step 9 (FIG. 4*j*): finally, the circuit I3 is switched to break its conduction. Therefore, the circuit I3 is rendered conductive only for the time required for the non-conduction of the circuit I1 and the conduction of the circuit I2. The transformer tap p2 is now connected to the output terminal b2 via the contacts C1 and C5 and the transformer tra;

step 10: opening of the contact C2 (FIG. 4*j*).

This operation is managed by the central control circuit CC (FIG. 3*a*).

In this operation, the contacts C1 to C5 are controlled in the absence of current. Therefore, they do not switch current; therefore, there is no risk of electrical arc creation.

Figure 5:
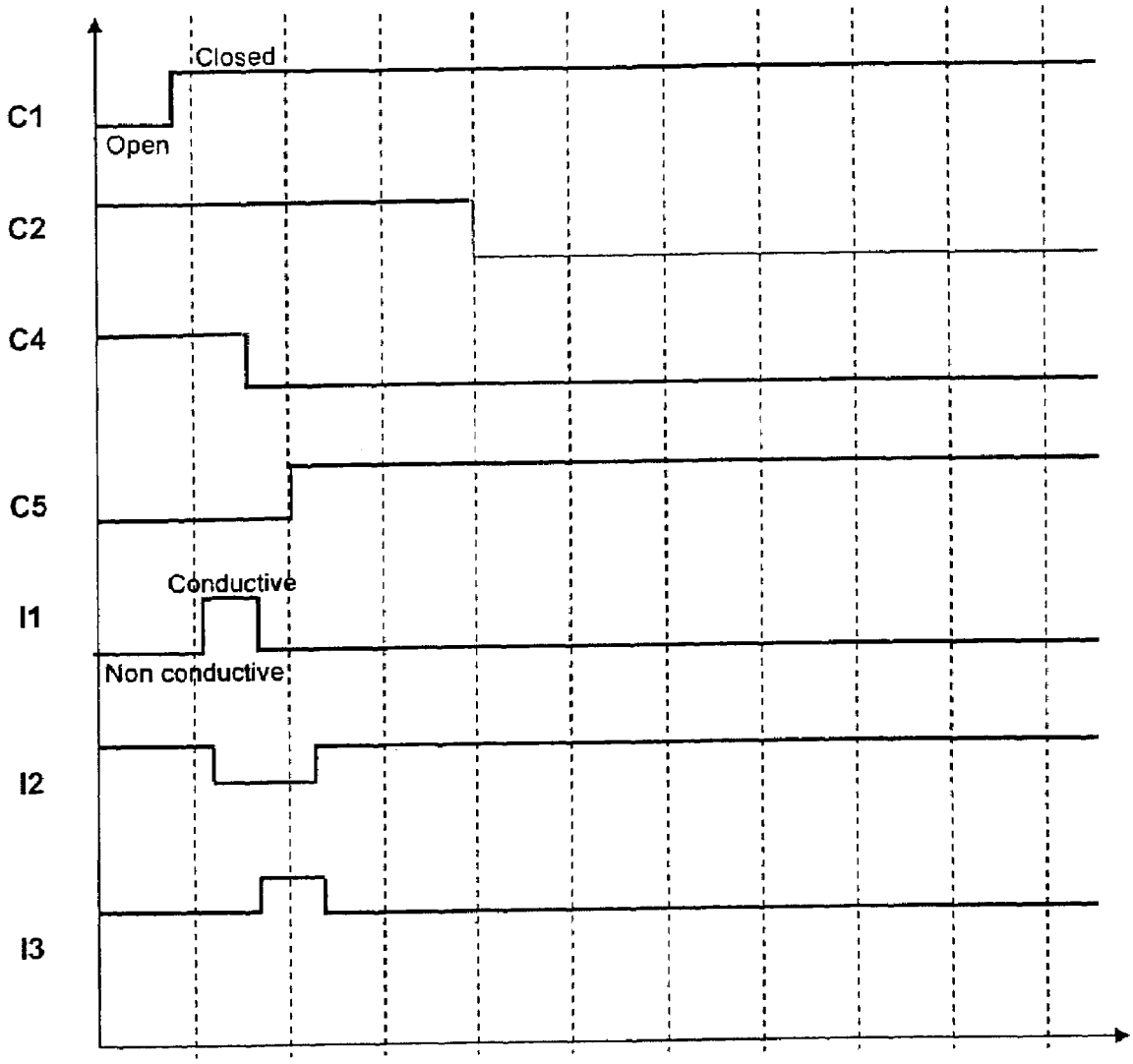

FIG. 5 illustrates this operation with timing diagrams. In these diagrams, the operation of each contact C1 to C4 and of each switching circuit I1 to I3 is individualised by a specific diagram. For the contacts C1 to C5, the top sections of the diagrams represent the closed positions of the contacts and the bottom sections of the diagrams represent the open positions of the contacts. In the case of the switching circuits I1 to I3, the top sections represent the conductive states of said circuits and the bottom sections, the non-conductive states.

Figure 1:
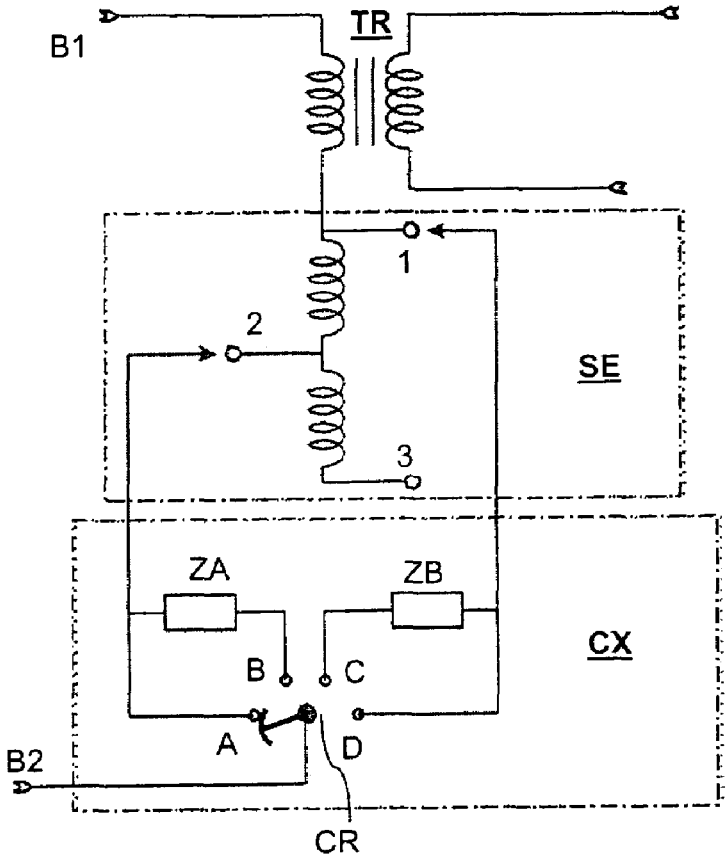
FIGS. 1 to 2*c*, transformer load changers known in the prior art.
Figure 2A:
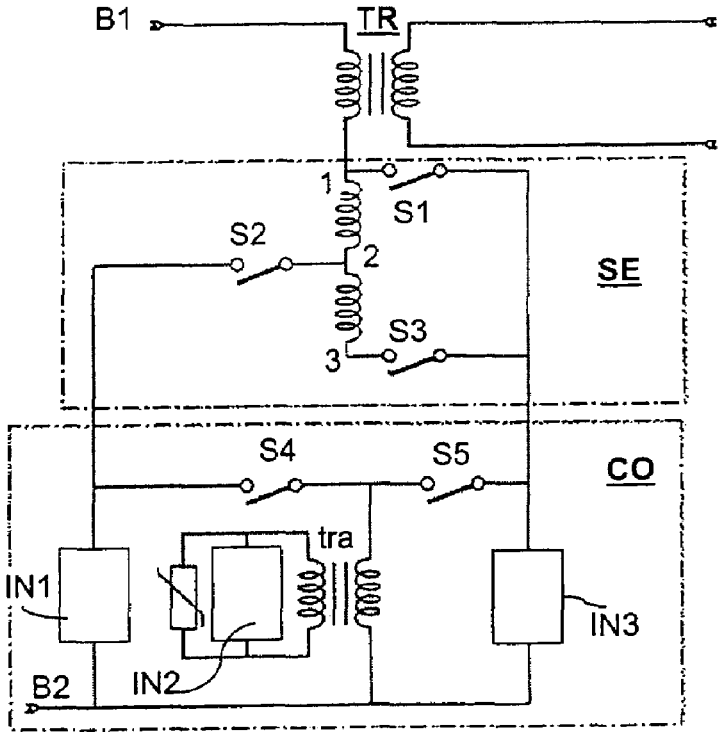
Figure 2B:
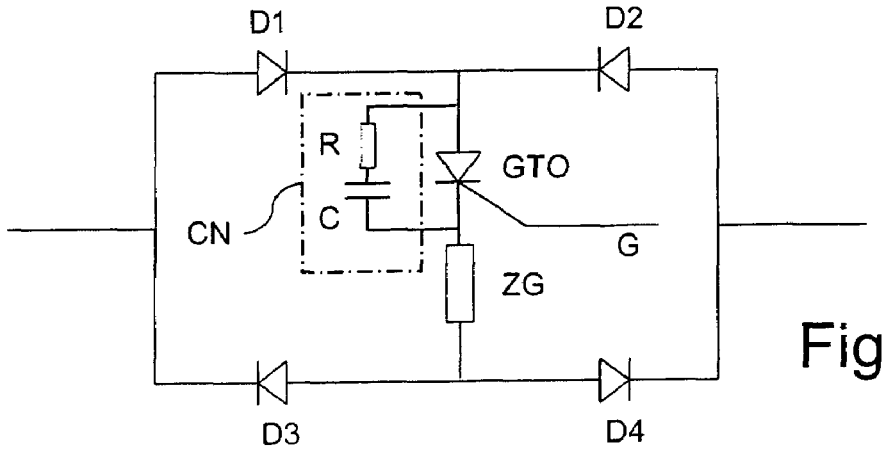
Figure 2C:
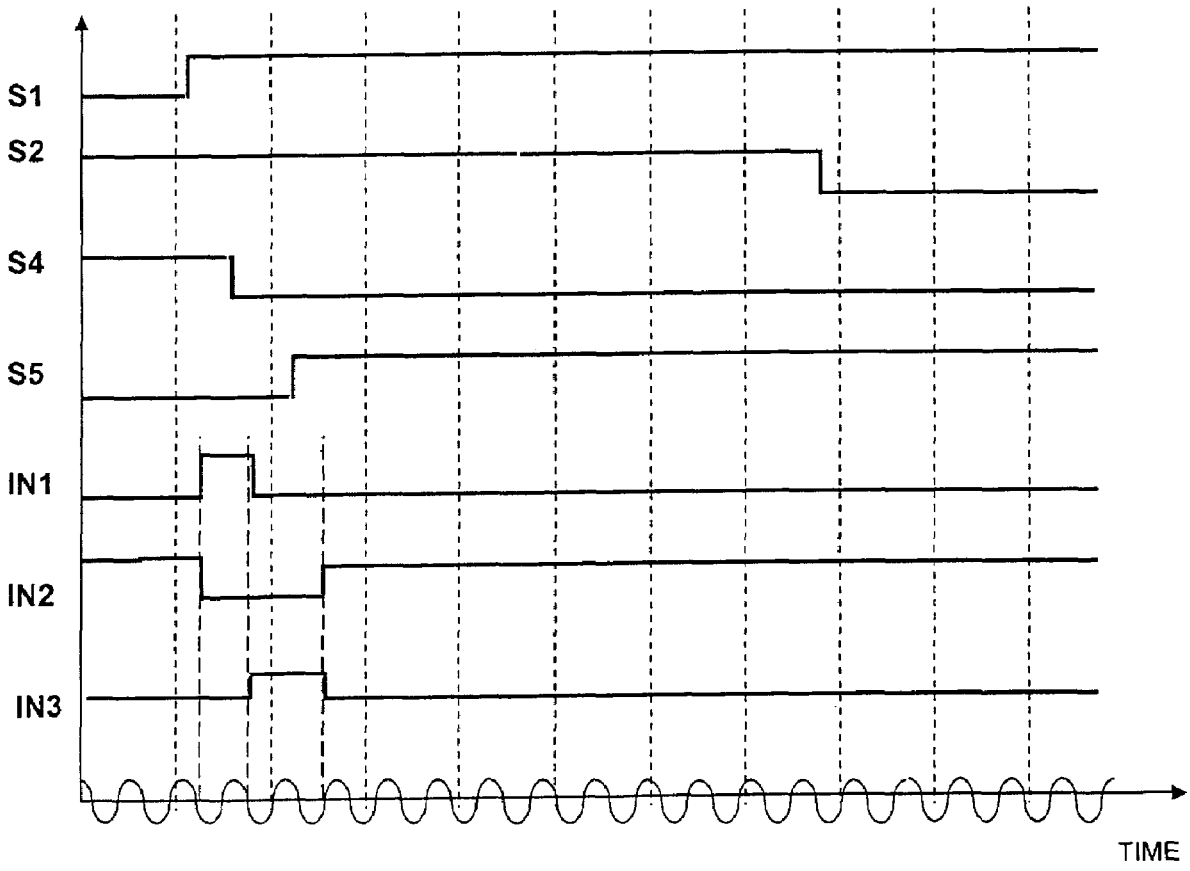

As seen in these diagrams, the operation of the system is independent from the value of the current flowing in the transformer secondary (no current zero transition detection in the transformer secondary circuit). Therefore, this operation is simpler than in the system known in the prior art, particularly that in FIGS. 2*a* to 2*c*. In addition, the switching circuits I1 to I3 are also simpler as they do not require RC circuits or inductive resistors to limit currents and voltages.

Therefore, the use of IGBT transistors avoids the presence of RC circuits and the power required for the control thereof is independent from the switched current. Switching when the current passes through zero is no longer a requirement which does away with the detection circuit and improves the reliability of the system.

In a three-phase application, the switching of the three phases is carried out simultaneously since this switching is independent from the current values on the three phases and the transitory imbalance is eliminated.

The invention claimed is:

1. An on-load transformer tap changing system in which a secondary or primary of a transformer includes at least one first tap and one second tap, the system comprising:

a main connection circuit used to connect, in a steady state condition, the first tap or the second tap to an output terminal of the transformer secondary or primary;

a first secondary connection circuit used to connect the first tap temporarily and directly to the output terminal of the transformer secondary or primary; and a second secondary connection circuit used to connect the second tap temporarily and directly to the output terminal, wherein each of the connection circuits comprises one or more insulated gate bipolar transistors, and wherein, when the first tap is connected to the output terminal via the first switching current, the central control circuit comprises a sequential operation enabling of following steps independently from the transformer load current value:

conduction of the first secondary connection circuit to make a temporary parallel connection of the first tap to the output voltage, conduction of the second secondary connection circuit to make a temporary connection of the second tap to the output terminal, connection of the main connection circuit to the second tap, non-conduction of the first secondary connection circuit, conduction of the main connection circuit, and non-conduction of the second secondary connection circuit.

* * * * *